US006252352B1

(12) United States Patent
Vollkommer et al.

(10) Patent No.: US 6,252,352 B1
(45) **Date of Patent: *Jun. 26, 2001**

(54) FLAT LIGHT EMITTER

(75) Inventors: Frank Vollkommer, Buchendorf; Lothar Hitzschke; Simon Jerebic, both of Munich, all of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/180,856

(22) PCT Filed: Mar. 20, 1998

(86) PCT No.: PCT/DE98/00830

§ 371 Date: Nov. 17, 1998

§ 102(e) Date: Nov. 17, 1998

(87) PCT Pub. No.: WO98/43278

PCT Pub. Date: Oct. 1, 1998

(30) Foreign Application Priority Data

Mar. 21, 1997 (DE) ..... 197 11 893

(51) Int. Cl.[7] ..... H01J 61/00

(52) U.S. Cl. ..... 313/574; 313/485; 313/491; 313/483

(58) Field of Search ..... 313/318.12, 483, 313/484, 485, 491, 492, 494, 495, 496, 497; 345/55, 74, 75, 355

(56) References Cited

U.S. PATENT DOCUMENTS 5,070,273 * 12/1991 Van Den Bogert et al. ..... 313/607
5,073,743 * 12/1991 Kajiwara et al. ..... 33/346 R
5,266,865 * 11/1993 Haizumi et al. ..... 313/506
5,276,378 * 1/1994 Gothard ..... 313/491
5,463,274 * 10/1995 Winsor ..... 313/493

FOREIGN PATENT DOCUMENTS 19526211 1/1997 (DE) .
0363832 4/1990 (EP) .
0547366 6/1993 (EP) .
2668634 4/1992 (FR) .
2079046 1/1982 (GB) .
9423442 10/1991 (WO) .

OTHER PUBLICATIONS

Patent Abstracts of Japan, vol. 097, No. 009, Sep. 30, 1997, & JP 09 120799 A (Nec Home Electron Ltd), May 6, 1997, siehe Zusammenfassung.
Patent Abstracts of Japan, vol. 013, No. 031 (E–707), Jan. 24, 1989 & JP 63 232261 A (Sanyo Electric Co Ltd), Sep. 28, 1998, siehe Zusammenfassung.

* cited by examiner

*Primary Examiner*—Nimeshkumar D. Patel
*Assistant Examiner*—Matthew J. Gerike
(74) *Attorney, Agent, or Firm*—Robert F. Clark

(57) ABSTRACT

A flat radiator having dielectrically impeded, strip-like cathodes (12;15) and anodes (8;9*a*) which are arranged alternately next to one another on the wall of the discharge vessel (14) has in each case an additional anode (9*b*) between neighbouring cathodes (12;12,15), that is to say an anode pair (9) is arranged in each case between the cathodes (12;12,15). The cathodes (15) have nose-like extensions (28) which face the respectively neighbouring anodes (8) and are arranged more densely in a spatially increasing fashion in the direction of the edges (26,27) of the flat radiator (13). As an alternative or in addition thereto, the two anode strips (9*a*,9*b*) of each anode pair (9) are widened in the direction of the edges (26,27) of the flat radiator (13) at one end in the direction of the respective partner strip (9*b* or 9*b*). Owing to these measures, the surface luminous density of the flat radiator (13) is largely constant towards the edges (26,27, 29,30) in pulsed operation.

27 Claims, 3 Drawing Sheets

FLAT LIGHT EMITTER

TECHNICAL FIELD

The invention proceeds from a flat radiator in accordance with the preamble of claim 1. Furthermore, the invention relates to a system composed of this flat radiator and a voltage source in accordance with the preamble of claim 10.

The designation "flat radiator" is understood here to mean radiators having a flat geometry and which emit light, that is to say visible electromagnetic radiation, or ultraviolet (UV) or vacuum ultraviolet (VUV) radiation.

Depending on the spectrum of the emitted radiation, such radiation sources are suitable for general and auxiliary lighting, for example home and office lighting or background lighting of displays, for example LCDs (Liquid Crystal Displays), for traffic lighting and signal lighting, for UV irradiation, for example sterilization or photolysis.

At issue here are flat radiators which are operated by means of dielectrically impeded discharge. In this type of radiator, either the electrodes of one polarity or all electrodes, that is to say of both polarities, are separated from the discharge by means of a dielectric layer (discharge dielectrically impeded at one end or two ends), see, for example, WO 94/23442 or EP 0 363 832. Such electrodes are also designated as "dielectric electrodes" below for short.

PRIOR ART

DE-A 195 26 211 discloses a flat radiator in which strip-shaped electrodes are arranged on the outer wall of a discharge vessel. The radiator is operated with the aid of a train of active power pulses separated from one another by pauses. Consequently, a multiplicity of individual discharges, which are delta-like (Δ) in top view, that is to say at right angles to the plane in which the electrodes are arranged, burn in each case between neighbouring electrodes. These individual discharges are lined up next to one another along the electrodes, widening in each case in the direction of the (instantaneous) anode. In the case of alternating polarity of the voltage pulses of a discharge dielectrically impeded at two ends, there is a visual superimposition of two delta-shaped structures. The number of the individual discharge structures can be influenced, inter alia, by the electric power injected.

In accordance with the equidistantly arranged strips, the individual discharges are—assuming an adequate electric input power—distributed virtually uniformly inside the planar-like discharge vessel of the radiator. However, it is disadvantageous in this solution that the surface luminous density drops sharply towards the edge. The reason for this is, inter alia, the missing contributory radiation at the edge from the neighbouring regions outside the discharge vessel.

A further disadvantage is that the individual discharges preferentially are formed between the anodes and only one of the two respectively directly neighbouring cathodes. Evidently, individual discharges do not form simultaneously on both sides of the anode strips independently of one another. Rather, it cannot be predicted by which of the two neighbouring cathodes the discharges will be formed in each case. Referring to the flat radiator as a whole, this results in a non-uniform discharge structure, and consequently in a temporally and spatially non-uniform surface luminous density.

A uniform surface luminous density is, however, desirable for numerous applications of such radiators. Thus, for example, the back lighting of LCDs requires a visual uniformity whose depth of modulation does not exceed 15%.

REPRESENTATION OF THE INVENTION

It is the object of the present invention to provide a flat radiator having strip-like electrodes in accordance with the preamble of claim 1 and whose surface luminous density is virtually uniform up to the edge.

This object is achieved by means of the characterizing features of claim 1. Particularly advantageous embodiments are to be found in the dependent claims.

The term "strip-like electrode" or "electrode strip" for short is to be understood here and below as an elongated structure which is very thin by comparison with its length and is capable of acting as an electrode. The edges of this structure need not necessarily be parallel to one another in this case. In particular, substructures along the longitudinal sides of the strips are also to be included. Moreover, a strip can also have a pattern, for example a zig-zag pattern or square-wave pattern.

The basic idea of the invention consists in using an adapted electrode structure to balance the fall, typical for flat radiators, in luminous density from the middle to the edges. The electrode structure is configured for this purpose to the effect that the electric power density increases towards the edges of the flat radiator.

In a first embodiment, the strip-shaped electrodes are arranged next to one another on a common wall of the discharge vessel (type I). This produces in operation an essentially planar-like discharge structure. The advantage is that shadows owing to the electrodes on the opposite wall are avoided. Instead of a single anode strip, as previously, two mutually parallel anode strips, that is to say an anode pair, are arranged in each case between the cathode strips. The result of this is to eliminate the problem outlined at the beginning that, in the quoted prior art, in each case only individual discharges of one of two neighbouring cathode strips burn in the direction of the individual anode strips situated therebetween.

In the following explanation of the principle of a first realization according to the invention of an electrode structure for a flat radiator of type I, reference is made to the diagrammatic representation in FIG. 1. In order to be able to discern the details more effectively, only a section of the electrode region is shown. The aim to be achieved is to construct the individual discharges in operation in a spatially more dense fashion towards the edges 1–3 of the flat radiator than in the remaining part of the discharge vessel. For this purpose, the cathode strips 4 are specifically shaped in such a way that they have spatially preferred root points for the individual discharges. These preferred root points are realized by nose-like extensions 6 facing the respectively neighbouring anode 5. Their effect is locally limited intensifications of the electric field, and consequently that the delta-shaped individual discharges 7 ignite exclusively at these points. The extensions 6 are arranged more densely in the direction of the narrow sides of the cathodes 4,4', that is to say in the direction of the edges 1,3 oriented perpendicular to the electrode strips 4,5. Typically, the mutual spacing between the extensions 6 at the edges 1,3 is only half as large as in the middle. In the direct vicinity of the corner points of the flat radiator, the spacing between the extensions 6 is finally reduced to about a third. An individual anode strip 5' is preferably arranged in each case in the direct neighbourhood of the edges 2 orientated parallel to the electrode strips 4,5 (the corresponding opposite second edge of the flat radiator is not represented in the selected detail of FIG. 1). Consequently, during operation the base sides of the delta-shaped (Δ) individual discharges lined up along these individual anode strips 5' are in each case in the direct neighbourhood of the corresponding edges 2. As a result, the drop in luminous density is also relatively slight as far as the vicinity of these edges 2. Furthermore, to provide support it is additionally possible for the extensions 8, facing the two individual anode strips 5', of the directly neighbouring cathode strips 4' to be arranged more densely overall than in the case of the remaining cathode strips 4. However, the mean power density is less than the maximum achievable power density. Consequently, with this solution, as well, it is not possible to achieve a maximum luminous density averaged over the entire flat radiator.

The second principle for realizing an electrode structure for a flat radiator of type I aims to increase the luminous density of the individual discharges to a greater extent the nearer they are arranged to the edge. This is achieved (compare the partial diagrammatic representation of the principle in FIG. 2) by virtue of the fact that the two anode strips 9*a*,9*b* of each anode pair 9 are widened in the direction of the edges 10,11 orientated perpendicular thereto, of the flat radiator. Typical values for the widening amount to a factor of approximately two for the edge regions of the flat radiator and to a factor of about three for the corner regions.

In a first variant, the anode strips are widened asymmetrically with respect to their longitudinal axis in the direction of the respective anodic partner strip 9*b* or 9*a*. Owing to this measure, the respective spacing d from the neighbouring cathode 12 remains constant throughout despite widening of the anode strips 9*a*,9*b*. Consequently, during operation the ignition conditions for all the individual discharges (not represented) are also the same along the electrode strips 9,12. It is ensured thereby that the individual discharges are formed in a fashion lined up along the entire electrode length (assuming an adequate electric input power).

In a second variant (not represented), the anode strips are widened in the direction of the respective neighbouring cathode. However, in this case the widening is only relatively weakly formed. This prevents the discharges from forming exclusively at the point of maximum width of the anode strip, that is to say at the point of the striking distance which is shortest in this case. The widening is distinctly smaller than the striking distance, typically approximately one tenth of the striking distance. Furthermore, both widening variants can also be combined, that is to say the widening is formed both in the direction of the respective anode partner strip and in the direction of the neighbouring cathode.

An increasing electric current density, and thus also an increasing luminous density of the individual discharges is achieved along the widening, with the result that it is possible effectively to balance the luminous density distribution up to the edges 10,11. However, it is no longer possible to realize the maximum luminous density in the middle region of the flat radiator owing to the increase in luminous density in the edge regions thereof. The advantage by comparison with the first solution is, however, that—assuming an adequate electric input power—it is possible to achieve the maximum spatial density of the individual discharges everywhere inside the discharge vessel, that is to say in this case the individual discharges are essentially directly adjacent to one another.

Moreover, the two principles for realizing the specific electrode shaping can also be combined with one another (compare FIG. 3*a*).

In the case of the anode widening, the cathodes need not necessarily be provided with extensions, as is shown merely by way of example in FIG. 2. Rather, the cathodes can also be designed as simple parallel strips in the case of the widened anode strips.

In order to minimize the drop in the surface luminous density at the edge, an experimental optimization of the dense packing of the extensions and/or of the anode widening is required in the concrete individual case.

In a further embodiment, the anode strips and cathode strips are arranged on mutually opposite walls of the discharge vessel (type II). During operation, the discharges consequently burn from the electrodes of one wall through the discharge chamber to the electrodes of the other wall. In this arrangement, each cathode strip is assigned two anode strips in such a way that, viewed in cross-section with respect to the electrodes, the imaginary connection of cathode strips and corresponding anode strips respectively yields the shape of a "V". The result of this is that the striking distance is greater than the spacing between the two walls. As has been shown, it is possible using this arrangement to achieve a higher UV yield than if anodes and cathodes are arranged alternately next to one another on only one common wall. According to the present state of knowledge, this positive effect is ascribed to reduced wall losses. The double anode strips are preferably arranged on the top plate, which serves primarily to couple out light, and the cathode strips are arranged on the base plate of the flat radiator. The advantage is the low shading of the useful light emitted by the top plate, since the anode strips are designed to be narrower than the cathode strips. For the purpose of as small as possible a drop in luminous density at the edge, as in the case of the type I flat radiator the cathode strips have extensions which are arranged increasingly more densely towards their narrow sides. As an addition or an alternative to this, the widening of the anode strips, already likewise explained in the case of the type I flat radiator, towards the edge of the flat lamp is also advantageous.

DESCRIPTION OF THE DRAWINGS

The invention is to be explained below in more detail with the aid of an exemplary embodiment. In the figures:

FIGS. 3*a*,3*b* show in a diagrammatic representation a top view and side view [sic] of a flat fluorescent lamp, that is to say a flat radiator, which emits white light during operation. This flat radiator is suitable for normal lighting or for background lighting of displays, for example LCD (Liquid Crystal Display). Features similar to those in FIGS. 1 and 2 are denoted below by means of the same reference numerals.

Figure 1:
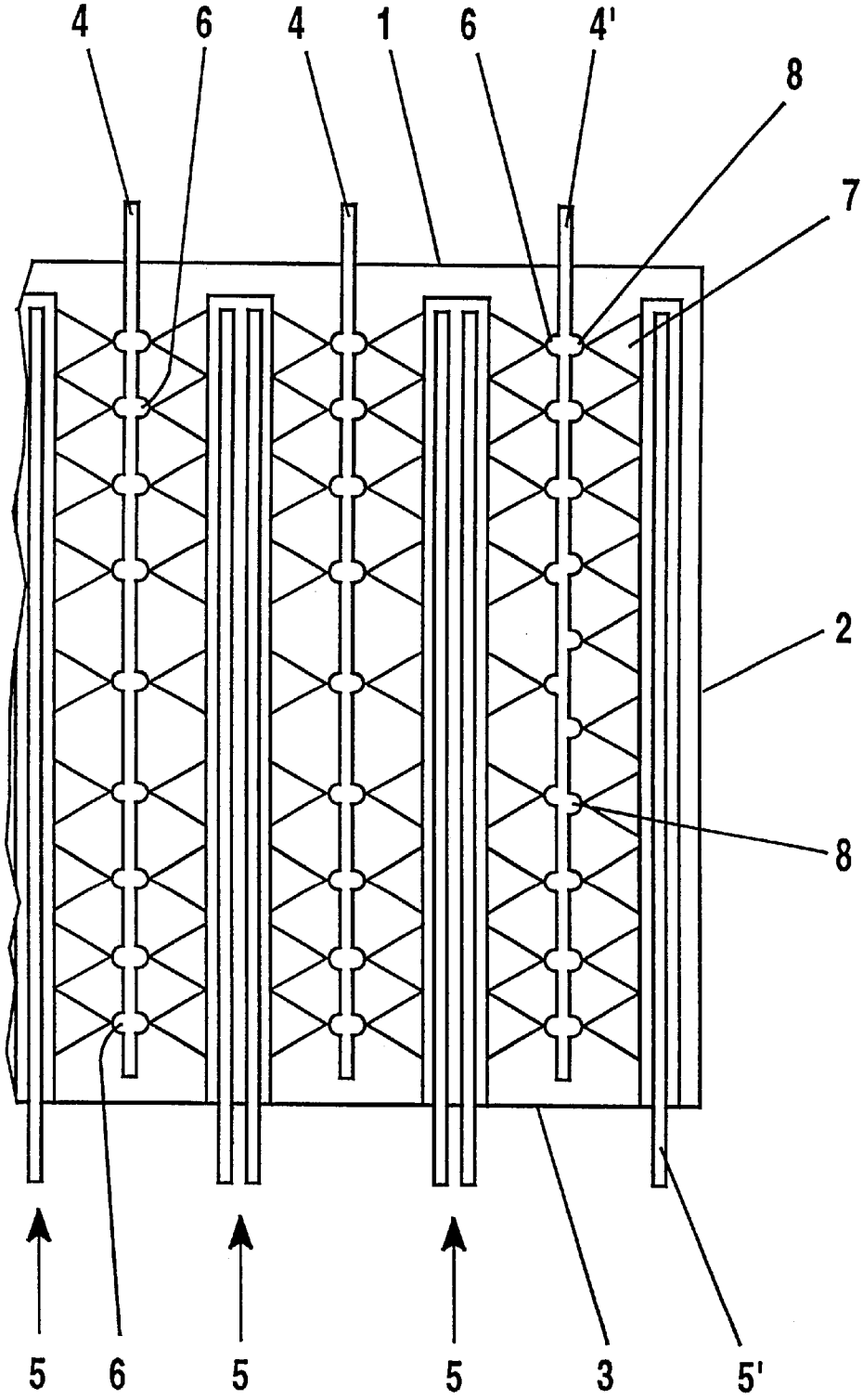
FIG. 1 shows a diagrammatic representation for explaining the principle of a first shaping of the electrodes according to the invention.

The flat radiator 13 comprises a flat discharge vessel 14 with a rectangular base face, four strip-like metallic cathodes 12, 15 (–) and dielectrically impeded anodes (+), of which three are constructed as elongated double anodes 9 and two are constructed as individual strip-shaped anodes 8. The discharge vessel 14 for its part comprises a base plate 18, a top plate 19 and a frame 9. The base plate 18 and top plate 19 are connected in a gas-tight fashion to the frame 20 by means of glass solder 21 in such a way that the interior 22 of the discharge vessel 14 is of cuboid construction. The base plate 18 is larger than the top plate 19 in such a way that the discharge vessel 14 has a free-standing circumferential edge. The inner wall of the top plate 19 is coated with a mixture of fluorescent materials (not visible in the representation), which converts the UV/VUV radiation generated by the discharge into visible white light. In one variant (not represented), in addition to the inner wall of the top plate, the inner wall of the base plate and of the frame are additionally also coated with a mixture of fluorescent materials. Furthermore, one light-reflecting layer each, made from $Al_2O_3$ and $TiO_2$, respectively, is applied to the base plate.

The cutout in the top plate 19 serves merely representational purposes and reveals the view onto a part of the anodes 8,9 and cathodes 12,15. The anodes 8,9 and cathodes 12,15 are arranged alternately and in parallel on the inner wall of the base plate 18. The anodes 8,9 and cathodes 12,15 are in each case extended at one of their ends and are guided to the outside on the baseplate 18 from the interior 22 of the discharge vessel 14 on both sides in such a way that the associated anodic or cathodic feedthroughs are arranged on mutually opposite sides of the baseplate 18. At the edge of the baseplate 18, the electrode strips 8,9,12,15 merge in each case into a cathode-side 23 or anode-side 24 bus-like conductor track. The two conductor tracks 23,24 serve as contacts for connecting with an electric voltage source (not represented). In the interior 22 of the discharge vessel 14, the anodes 8,9 are completely covered with a glass layer 25 (see also FIGS. 1 and 2), whose thickness is approximately 250 $\mu$m.

Figure 2:
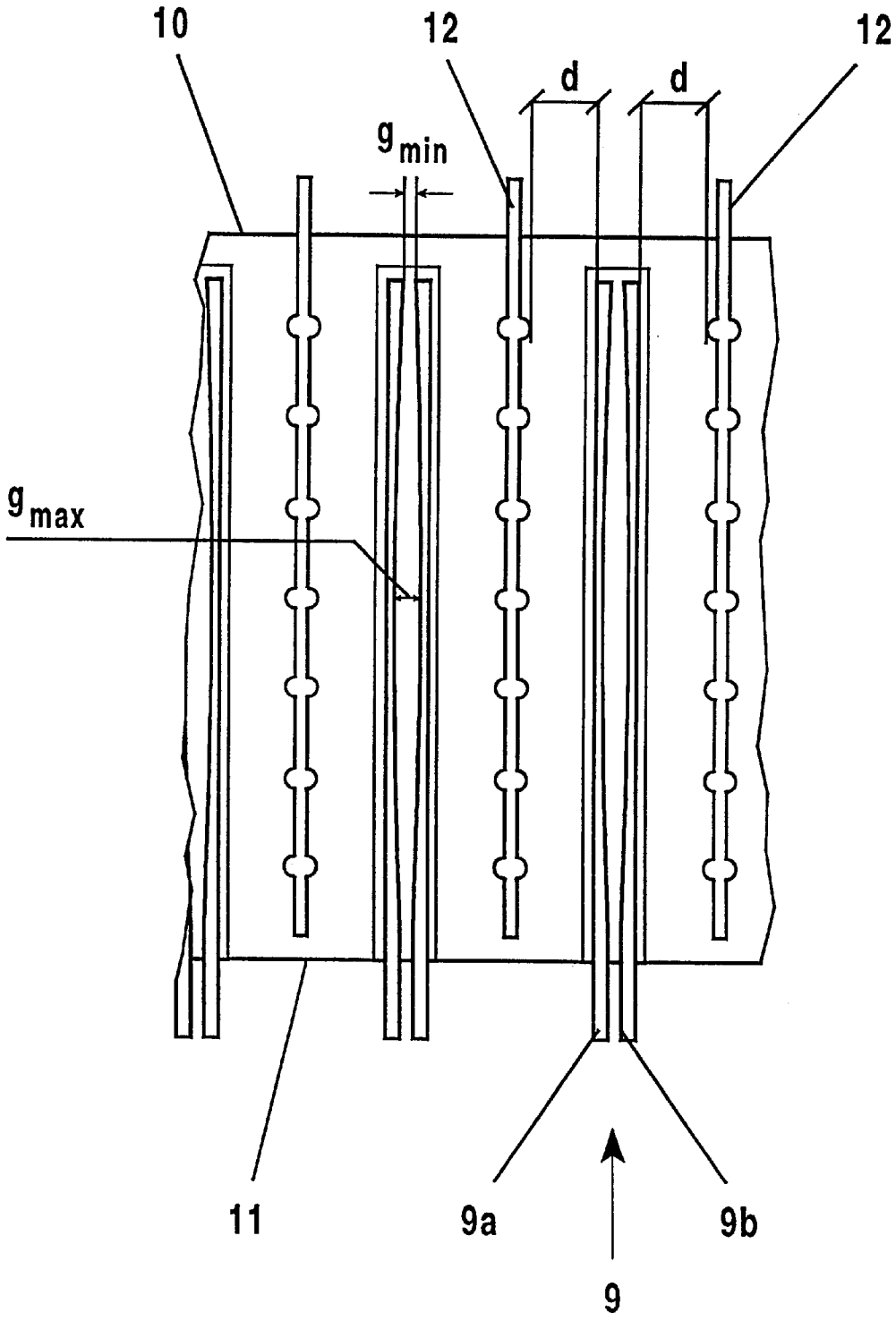
FIG. 2 shows a diagrammatic representation for explaining the principle of a second shaping of the electrodes according to the invention.

The double anodes 9 respectively comprise two mutually parallel strips, as already represented in detail in FIG. 2. In the direction of the edges 26,27 orientated at right angles to them, the two anode strips 9*a*,9*b* of each anode pair 9 are widened at one end in the direction of the respective partner strip 9*b* or 9*a*. The anode strips 9*a*,9*b* are approximately 0.5 mm wide at the narrowest point, and approximately 1 mm wide at the widest point. The mutually largest spacing $g_{max}$ (compare FIG. 2) of the two strips of each anode pair 9 is approximately 4 mm, while the smallest spacing $g_{min}$ is approximately 3 mm. The two individual anode strips 8 are in each case arranged in the direct vicinity of the two edges 29,30 of the flat radiator 13 which are parallel to the electrode strips 8,9,12,15.

The cathode strips 12; 15 have nose-like extensions 28 which face the respectively neighbouring anode 8; 9. As a result of them, there are locally limited intensifications in the electric field and, consequently, the delta-shaped individual discharges (not represented in FIG. 3*a*, 3*b* but compare FIG. 1) ignite exclusively at these points. The extensions 28 of the two cathodes 15, which are the direct neighbours of the edges 29, 30 of the flat radiator 13 which are parallel to the electrode strips 8,9,12,15, are arranged more densely along the respective longitudinal sides, facing the said edges 29, 30, in the direction of the narrow sides of the cathodes 15. The spacing d (compare FIG. 2) between the extensions 28 and the respective directly neighbouring anode strip is approximately 6 mm.

The electrodes 8,9,12,15 including the feedthroughs and supply leads 23,24 are constructed respectively as cohering cathode-side or anode-side structures resembling conductor tracks. The structures are applied directly to the base plate 18 by means of the silkscreen printing technique.

A gas filling of xenon with a filling pressure of 10 kPa is located in the interior 22 of the flat radiator 13.

Figure 3A:
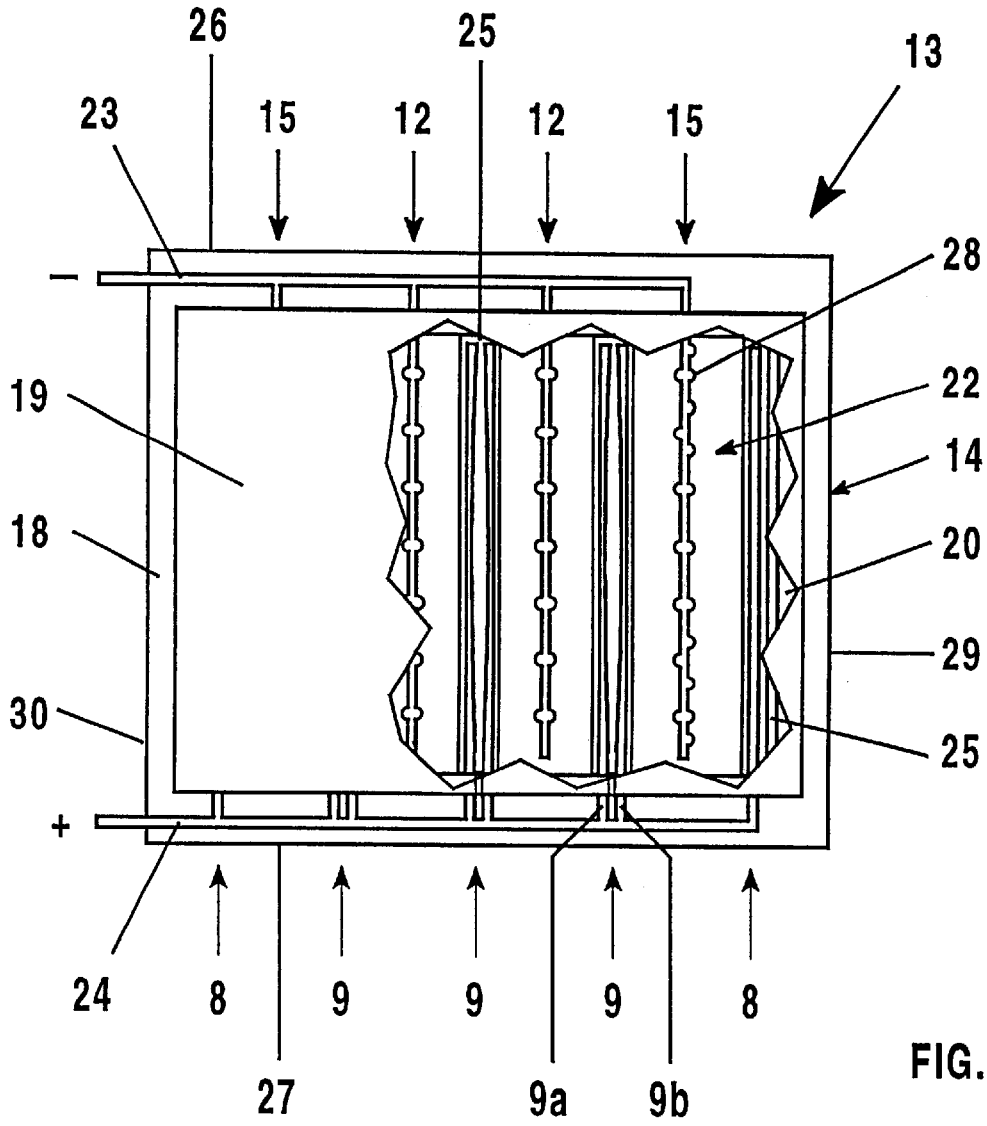
FIG. 3*a* shows a diagrammatic representation of a partially cut away top view of a flat radiator according to the invention.
Figure 3B:
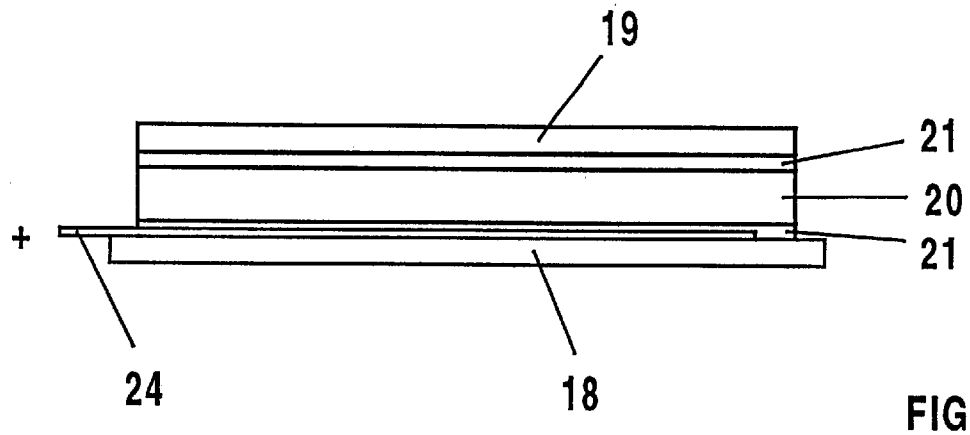
FIG. 3*b* shows a diagrammatic representation of a side view of the flat radiator of FIG. 3*a*.

One variant (not represented) differs from the flat radiator represented in FIGS. 3*a*, 3*b* merely in that not only the anodes but also the cathodes are separated from the interior of the discharge vessel by a dielectric layer (discharge dielectrically impeded at both ends).

In a complete system, the anodes 8,9 and cathodes 12,15 of the flat radiator 13 are connected via the contacts 24 and 23, respectively, to one pole each of a pulsed voltage source (not represented in FIGS. 3*a*,3*b*). During operation, the pulsed voltage source supplies unipolar voltage pulses which are separated from one another by pauses. In this case, a multiplicity of individual discharges are formed (not represented in FIGS. 3*a*,3*b*), which burn between the extensions 28 of the respective cathode 12;15 and the corresponding directly neighbouring anode strip 8;9.

The invention is not restricted to specified exemplary embodiments. It is also possible in addition, to combine features of different exemplary embodiments.

What is claimed is:

1. Flat radiator having an at least partially transparent discharge vessel which is closed and filled with a gas filling or open and flowed through by a gas filling and consists of electrically non-conducting material, and having strip-like electrodes comprising anodes and cathodes arranged on a wall of the discharge vessel, at least the anodes being separated in each case from the interior of the discharge vessel by a dielectric material, the cathodes having nose-like extensions facing neighbouring anodes, the extensions being arranged more densely in a spatially increasing fashion in the direction of the respective two narrow sides of the cathodes.

2. Flat radiator according to claim 1, characterized in that the anode strips are widened in the direction of their respective two narrow sides.

3. Flat radiator according to claim 2, characterized in that the anodes are widened by a factor of about 2.

4. Flat radiator according to claim 2, characterized in that the anodes are widened by a factor of about 3.

5. Flat radiator according to claim 1, characterized in that the strip-like electrodes are arranged next to one another on a common inner wall of the discharge vessel, and the anodes are arranged in pairs between neighbouring cathode strips.

6. Flat radiator according to claim 5, characterized in that the two anode strips of each anode pair are widened in the direction of their respective two narrow sides and asymmetrically with respect to their longitudinal axis in the direction of the respective partner strip, so that the respective spacing (d) from the neighbouring cathode is constant throughout.

7. Flat radiator according to claim 1, characterized in that the electrode strips are arranged on the inner wall of the discharge vessel, at least the anode strips being completely covered by a dielectric layer.

8. Flat radiator according to claim 1, characterized in that the electrodes including feedthroughs and supply leads are constructed as in each case functionally different subregions of a continuous cathode-side or anode-side structure resembling a conductor track.

9. Flat radiator according to claim 1, characterized in that at least a part of the inner wall of the discharge vessel has a layer made from a fluorescent material or a mixture of fluorescent materials.

10. System having a flat radiator and an electric pulsed voltage source which is suitable for delivering voltage pulses separated from one another by pauses during operation, characterized in that the flat radiator has features of claim 1.

11. Flat radiator according to claim 5, characterized in that the anode strips are widened in the direction of their respective two narrow sides and asymmetrically with respect to their longitudinal axis in the direction of the neighbouring cathode.

12. Flat radiator according to claim 11, characterized in that the widening is approximately one-tenth of the striking distance.

13. Flat radiator according to claim 1, characterized in that the mutual spacing between the extensions at the narrow sides of the cathode is one-half the mutual spacing between the extensions in the middle of the cathode.

14. Flat radiator according to claim 1, characterized in that the mutual spacing between the extensions at the narrow sides of the cathode is about one-third the mutual spacing between the extensions in the middle of the cathode.

15. Flat radiator according to claim 1, characterized in that the cathodes and anodes are on mutually opposite walls of the discharge vessel.

16. Flat radiator having an at least partially transparent discharge vessel which is closed and filled with a gas filling or open and flowed through by a gas filling and consists of electrically non-conducting material, and having strip-like electrodes comprising anodes and cathodes arranged on a wall of the discharge vessel, at least the anodes being separated in each case from the interior of the discharge vessel by a dielectric material, and the anodes being widened in the direction of their respective two narrow sides.

17. Flat radiator according to claim 16, characterized in that the strip-like electrodes are arranged next to one another on a common inner wall of the discharge vessel, the anodes being arranged in pairs between neighbouring cathode strips, and the anodes being widened in the direction of their narrow sides and asymmetrically with respect to their longitudinal axis in the direction of their neighbouring cathode.

18. Flat radiator according to claim 17, characterized in that the widening is approximately one-tenth of the striking distance.

19. Flat radiator according to claim 16, characterized in that the anodes are widened by a factor of about 2.

20. Flat radiator according to claim 16, characterized in that the anodes are widened by a factor of about 3.

21. Flat radiator according to claim 16, characterized in that the cathodes and anodes are on mutually opposite walls of the discharge vessel.

22. Flat radiator according to claim 16, characterized in that the strip-like electrodes are arranged next to one another on a common inner wall of the discharge vessel, the anodes being arranged in pairs between neighbouring cathode strips, and the anodes being widened in the direction of their respective two narrow sides and asymmetrically with respect to their longitudinal axis in the direction of the respective partner strip, so that the respective spacing (d) from the neighbouring cathode is constant throughout.

23. Flat radiator according to claim 16, characterized in that the strip-like electrodes are arranged next to one another on a common inner wall of the discharge vessel, the anodes being arranged in pairs between neighbouring cathode strips, and the anodes being widened both in the direction of their respective two narrow sides and in the direction of the respective partner strip.

24. Flat radiator having an at least partially transparent discharge vessel which is closed and filled with a gas filling or open and flowed through by a gas filling and consists of electrically non-conducting material, and having strip-like electrodes comprising anodes and cathodes arranged on the wall of the discharge vessel, at least the anodes being separated in each case from the interior of the discharge vessel by a dielectric material, and the luminous density of individual discharges between the electrodes increasing in operation towards an edge of the discharge vessel.

25. Flat radiator according to claim 24, characterized in that the flat radiator has an electric pulsed voltage source which is suitable for delivering voltage pulses separated from one another by pauses during operation.

26. Flat radiator according to claim 25, characterized in that the electrodes are arranged next to one another on a common wall of the discharge vessel.

27. Flat radiator according to claim 25, characterized in that the cathodes and anodes are on mutually opposite walls of the discharge vessel.

* * * * *